United States Patent [19]

Kreidler et al.

[11] 3,964,734

[45] June 22, 1976

[54] APPARATUS FOR THERMALLY TREATING METAL COMPONENTS

[76] Inventors: Alfred Kreidler, Postfach 367, CH-8053, Zurich, Switzerland; Klaus Viessmann, Friedrich-Ebertstr 110, D-7014 Kornwestheim, Germany

[22] Filed: Aug. 10, 1973

[21] Appl. No.: 387,278

[30] Foreign Application Priority Data

Aug. 11, 1972 Germany ..... 2239552

[52] U.S. Cl. ..... 266/133; 148/13.1

[51] Int. Cl.² ..... C21D 1/50

[58] Field of Search ..... 266/2 R, 4 R, 4 A, 6 R; 148/13, 13.1, 13.2, 14, 18, 20.6

[56] References Cited

UNITED STATES PATENTS

| | | | |
|---|---|---|---|
| 752,768 | 2/1904 | Goodwin | 266/4 A |
| 890,148 | 6/1908 | Machlet | 266/4 R |
| 890,250 | 6/1908 | Thompson | 266/4 R |
| 1,085,197 | 1/1914 | Fairbanks | 266/4 R |
| 1,151,675 | 8/1915 | Dyblie | 266/6 R |
| 2,352,709 | 7/1944 | Haase | 266/4 R |
| 2,664,901 | 1/1954 | Gehr et al. | 266/6 R |
| 2,793,027 | 5/1957 | Matthey | 148/20.6 |
| 3,164,656 | 1/1965 | Ipsen | 266/6 R |
| 3,340,109 | 9/1967 | Keough | 266/6 R X |
| 3,343,946 | 9/1967 | Phillips et al. | 266/6 R |

FOREIGN PATENTS OR APPLICATIONS

| | | | |
|---|---|---|---|
| 84,035 | 3/1921 | Australia | 266/6 R |
| 476,059 | 8/1951 | Canada | 266/6 R |
| 14,648 | 6/1911 | United Kingdom | 266/6 R |
| 221,249 | 9/1924 | United Kingdom | 266/6 R |

*Primary Examiner*—Gerald A. Dost
*Attorney, Agent, or Firm*—Steinberg and Blake

[57] ABSTRACT

Apparatus for thermally treating metal components. The metal components which are in a partially finished condition are annealed by being placed within a liquid bath which is at a temperature of between 200° and 300° C. The liquid bath is oil and is situated within an enclosure structure with which an inlet and outlet structure communicate for introducing and discharging the metal components from the treating bath. These inlet and outlet structures themselves contain liquid for sealing off the interior of the enclosure from the outer atmosphere.

18 Claims, 6 Drawing Figures

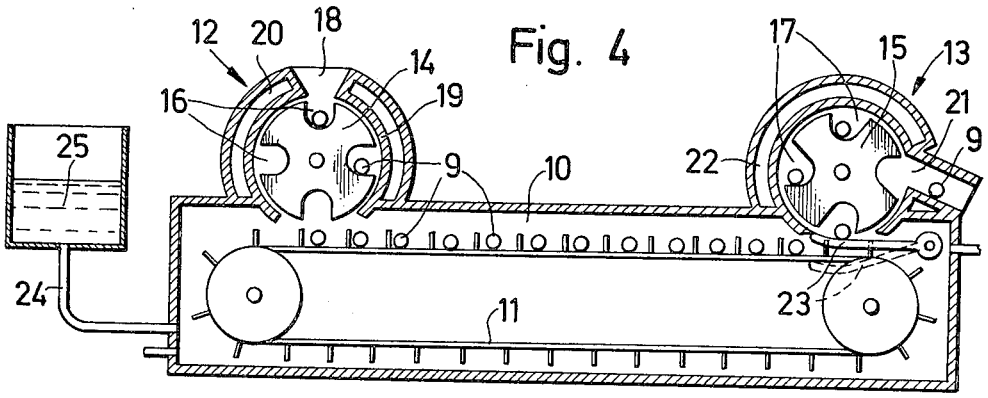
Fig. 4
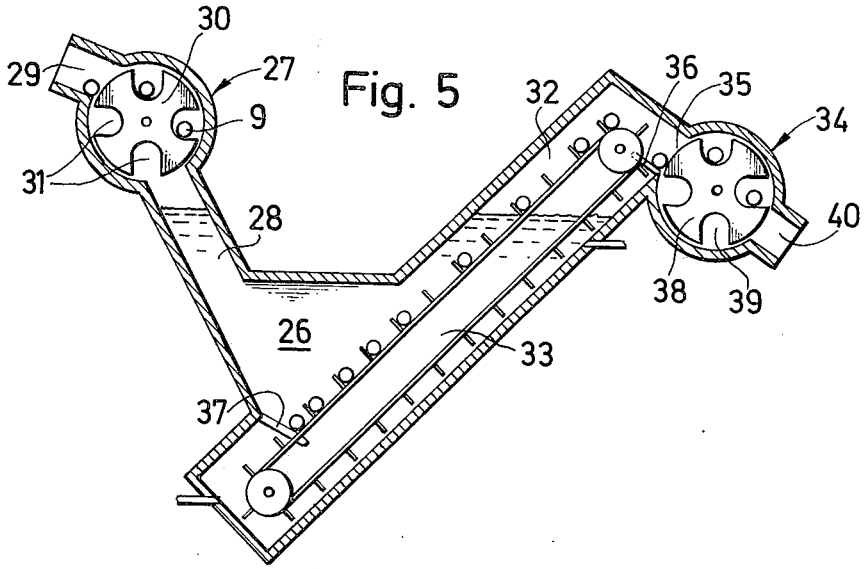
Fig. 5
Fig. 6
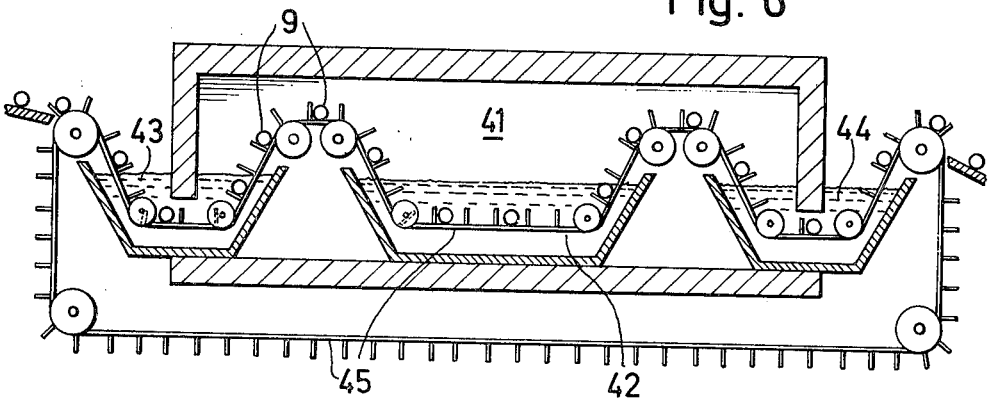

APPARATUS FOR THERMALLY TREATING METAL COMPONENTS

BACKGROUND OF THE INVENTION

The present invention relates to apparatus for annealing metal components which are in a partially finished condition.

Thus, the present invention relates to a method and apparatus for thermally treating metal components at a temperature of 200° – 300° C. With certain metal components which are partially finished, in particular partially finished brass components, the possibility of corrosion or other defective structures occurring in the components due to stresses therein can be eliminated by thermally relieving the stresses. However, up to the present time it has not been possible to relieve these stresses with a thermal treatment of the above type while at the same time achieving a continuous operation with a high output and with a desirable low cost.

It is known, for example, to provide thermal treatment of the above type by utilizing a salt bath which at a temperature of between 200° and 300° C has a sufficiently low viscosity. With such a treating bath it is possible to treat the articles quickly, within minutes, with the components being successively introduced into the bath rapidly one after the other so that it is possible to treat in this way, in suitable stages, partially finished products which are in the process of being manufactured into finished products, such metal components being made of aluminum alloy, for example. Such methods and apparatus, however, are extremely expensive and carry with them the disadvantage that the salt bath will attack many non-ferrous metals. Furthermore, after the thermal treatment of the partially finished components in the above manner, it is necessary to remove from the components, by washing, the salt which otherwise clings to the components, and this removal of the salt results in considerable difficulties particularly in connection with cleaning of the washing water and in connection with the unavoidable lengthening of the total treating time.

Furthermore, it is known to make use of trivalent or tetravalent alcohols, or mixtures thereof, for the above purposes. However, such methods and apparatus are also expensive and thus have not been widely used.

Also, known baths of molten metal have proved to be unsuitable because of the ease with which metal components, particularly non-ferrous metal components, dissolve in such molten metal baths.

It is also known to use for the above purposes oil and fats which are heated so as to provide the thermal treatment. However, in practice such materials have also not been used since at the required temperatures of between 200° and 300° C, these treating materials have a high vapor pressure and therefore easily vaporize. Moreover, such treating baths have not been used because they quickly deteriorate and are rendered useless as a result of oxidation.

It is also known to treat partially finished metal components thermally in furnaces in which hot air is circulated. However, such furnaces have their own peculiar drawbacks because of the thermal properties of the hot air, the small heat capacity and poor heat transfer, and because of the relatively long heating time required for the components which are treated. Thus, with such methods and apparatus it is essential, in order to achieve a technically useful output, to treat stacks of semifinished products simultaneously.

However, when treating such stacks of products, the heat treatment is not uniform because a much longer treatment time is required for those components which are situated at the interior of the stack, as compared with those components which are at the exterior of the stack. The result is that particularly long dwelling periods of the stacked components on the order of 5–6 hours, are required, with little possibility of achieving the desired treatment at a low cost and with a lack of uniform treatment of all of the components. Furthermore, it is not possible to situate structures, which operate in this way on stacks of components, in an automatically operating series of units which act on the components to finish them in accordance with mass production techniques. In other words, it is not possible to situate such structures along a production line.

SUMMARY OF THE INVENTION

It is accordingly a primary object of the present invention to provide apparatus which will avoid the above drawbacks while permitting metal components of the above type to be thermally treated in a liquid bath at a temperature of 200° – 300° C.

It is furthermore an object of the present invention to provide apparatus capable of rapidly treating metal components so that a high output is achieved at a relatively low cost.

In addition, it is an object of the present invention to provide apparatus which will reliably maintain a liquid treating bath in an effective operating condition over a long period of time, so that the problem of deterioration of the bath within a relatively short period can be avoided.

Furthermore, it is an object of the present invention to provide apparatus capable of handling the metal components in such a way that a relatively small amount of space is required for the treatment.

Thus, it is an object of the invention to provide a simple, effective apparatus which at relatively low cost is capable of thermally treating metal components over a long period of time in a highly efficient manner.

According to the invention the treating liquid is preferably oil, such as mineral oil, maintained closed off from the outer atmosphere and at an elevated temperature so that the metal components can be effectively treated in such a bath. The oil for treating the metal components is situated within an enclosure means with which an inlet means communicates for introducing the metal components and with which an outlet means also communicates for discharging the treated components out of the bath. The inlet means and outlet means form the only parts of the structure through which the interior of the enclosure means can communicate with the outer atmosphere, and the inlet means and outlet means themselves have hollow interiors across which a liquid extends so as to maintain the interior of the enclosure means effectively sealed off from the outer atmosphere, thus preventing deterioration of the treating bath.

BRIEF DESCRIPTION OF DRAWINGS

The invention is illustrated by way of example in the accompanying drawings which form part of this application and in which:

FIG. 4 is a schematic longitudinal sectional illustration of a further embodiment of apparatus according to the invention;

FIG. 5 is a schematic sectional elevation of a still further embodiment of a structure according to the invention; and FIG. 6 is a longitudinal sectional elevation schematically illustrating yet another apparatus according to the invention.

DESCRIPTION OF PREFERRED EMBODIMENTS

Figure 1:
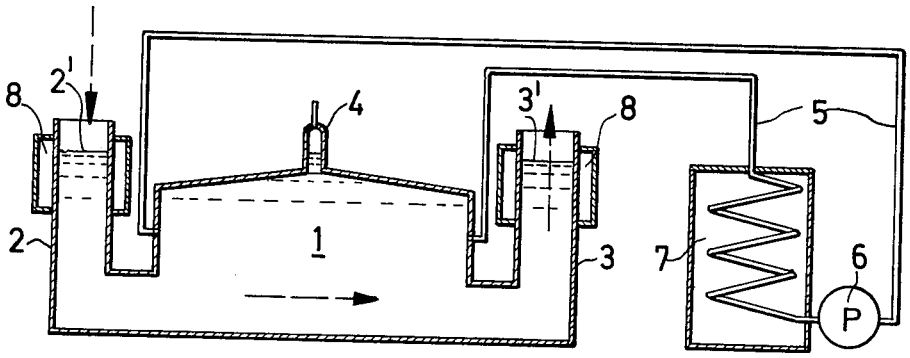
FIG. 1 is a schematic sectional elevation of one possible embodiment of apparatus according to the invention.

Referring to FIG. 1, there is illustrated therein an enclosure means 1 in the interior of which is situated the heat-treating liquid such as oil. This enclosure means 1 communicates at its left, as viewed in FIG. 1, with an inlet means 2 and at its right, as viewed in FIG. 1, with an outlet means 3. The inlet means 2 is in the form of a tube or pipe through which a metal component is introduced into the interior of the enclosure means 1 while the outlet means 3 is also in the form of a tube or pipe through which the metal components are discharged from the interior of the enclosure means 1. In the example of FIG. 1 the enclosure means 1 is also provided at its uppermost portion with a tubular, upwardly directed extension 4 in which vapor can accumulate and from which vapor can be discharged as required. The entire interior of the enclosure means 1 is filled with the oil which is at the elevated temperature for thermal treatment of the metal components. It will be noted that the treating oil extends into the interiors of the inlet means 2 and outlet means 3 where the surfaces 2′ and 3′ are indicated in FIG. 1, with the downwardly and upwardly directed arrows respectively associated with the inlet and outlet means 2 and 3 illustrating the direction of movement of the components which are treated. It will be noted that in the interior of the enclosure means 1 there is an illustration of a horizontal arrow showing the direction of movement of the components from the inlet means toward the outlet means through the interior of the enclosure means 1. These exposed surfaces 2′ and 3′ of the treating liquid are preferably maintained in any suitable way in contact with an inert gas such as nitrogen. Thus in any suitable way layers of nitrogen may be maintained in contact with the surfaces 2′ and 3′ of the treating liquid. The top end of the tubular extension 4 carries a pressure-responsive valve which automatically opens when a given pressure is reached for releasing vapors. Thus it is only at a predetermined elevated vapor pressure that any discharge of vapor will take place from the extension 4. The oil is filled into the interior of the enclosure means 1 through any suitable filling opening which is suitably closed off fully from the outer atmosphere.

The three tubular structures 2, 3 and 4 of the embodiment of FIG. 1 form spaces which communicate with each other through the interior of the enclosure means 1, so that the level of the treating oil can in this way reach all the way up to almost the top ends of the tubular inlet and outlet means 2 and 3.

A circulating means communicates with the interior of the enclosure means 1 for circulating the treating liquid therein. This circulating means is illustrated as including the tubes 5 which communicate with the interior of the enclosure means 1 in the manner illustrated in FIG. 1. These tubes 5 are connected to a pump 6 which operates to circulate the treating liquid through the tubes 5 and through the interior of the enclosure means 1. Part of one of the tubes 5 is in the form of a coil situated in an oil heater 7 which may be heated by a suitable gas or oil. Thus the unit 7 forms a heating means for heating the treating liquid which is circulated by the circulating means 5, 6.

Cooling jackets 8 are situated around the inlet and outlet means 2 and 3 at the region of their upper ends. Thus, the cooling jackets 8 are situated at the elevations of the surfaces 2′ and 3′ of the treating liquid. These cooling jackets define spaces surrounding the tubular inlet and outlet means 2 and 3 and through which a cooling water can be circulated in any suitable way.

As the treating oil flows through the heating means 7 it becomes possible to provide at the treating oil a temperature which maintains this treating oil in the interior of the enclosure means 1 at a temperature of, for example, 250° C. As a result of the cooling achieved by the water jackets 8 it is possible to maintain the oil in the inlet means 2 and the outlet means 3 at a temperature of 190° C. In this way as well as by maintaining a layer of nitrogen in contact with the surfaces 2′ and 3′, it is possible to avoid a premature oxidation and deterioration of the oil. Tests have demonstrated that when using a thermal treating oil with a relatively low vapor pressure curve, as is the case with mineral oil, an operating life of 2000 – 3000 hours can be reliably expected.

Figure 2:
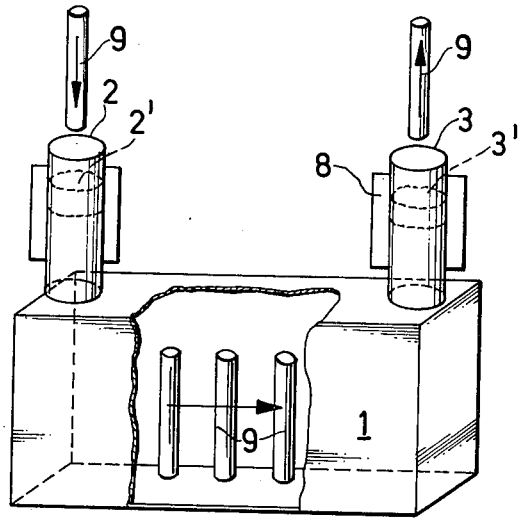
FIG. 2 is a schematic representation of the manner in which components are treated with the apparatus of the invention.

In the embodiment of the invention which is illustrated in FIG. 2, the enclosure means 1 has the configuration of a box-shaped enclosure in which the treating oil is located. In this case the inlet means 2 and outlet means 3 are in the form of vertically extending tubes projecting upwardly from the top wall of the enclosure means 1, and FIG. 2 schematically illustrates the surfaces 2′ and 3′ of the treating liquid which completely fills the enclosure means 1 and extends upwardly along the interiors of the tubular inlet and outlet means 2 and 3 up to the levels 2′ and 3′ at the region of the top ends of the inlet means 2 and outlet means 3 which in the case of FIG. 2 also are surrounded by the cooling means 8. The height of the hollow interior of the enclosure means 1 is only slightly greater than the length of the elongated metal components 9 which are treated. Also, the interior diameters of the tubular inlet means 2 and tubular outlet means 3 are only slightly greater than the diameters of the elongated metal components 9. Therefore, with the embodiment of the invention which is illustrated in FIG. 2 it is possible to introduce and discharge the components 9 through the inlet means 2 and outlet means 3, respectively, while moving the metal components 9 in the direction of their longitudinal axes, the movement of the metal components being achieved through known transporting structures. However, in the interior of the enclosure means 1 the metal components 9 are moved in a direction which is transverse to their longitudinal axes. In this case also any suitable known conveyor structure can be utilized for moving the metal components 9 in the manner shown by the lower horizontal arrow of FIG. 2 in the treating bath. With the method and apparatus of the invention it is only required to maintain each of the metal components 9 in the treating bath in the interior of the enclosure means 1 for a treating period which in its total is on the order of 1–2 minutes. Thus, it will be noted that with the method and apparatus of FIG. 2 the orientation of the metal components 9 is maintained unchanged throughout the entire movement thereof through the inlet means 2, along the interior of the enclosure means 1, and out through the outlet means 3.

Figure 3:
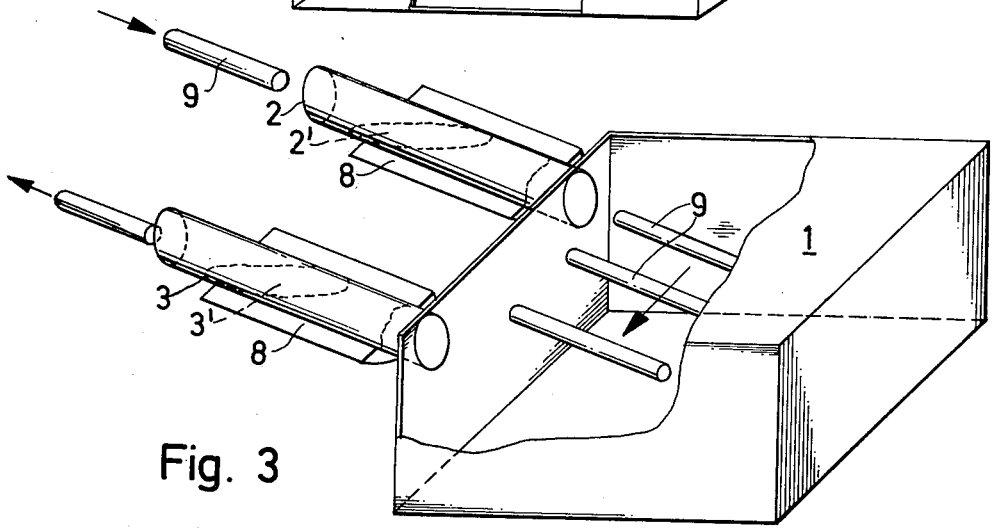
FIG. 3 is a schematic perspective illustration, partly broken away, for illustrating a further apparatus for treating components in accordance with the invention.

The embodiment of the invention which is illustrated in FIG. 3 differs from that of FIG. 2 in that the tubular inlet means 2 and outlet means 3 are inclined upwardly from a vertical wall of the enclosure means 1. In the example illustrated in FIG. 3 the inlet means 2 and outlet means 3 may extend upwardly from the left wall of the enclosure means 1 at an angle of, for example, 20° with respect to a horizontal plane.

While the embodiment of FIG. 2 the upper surfaces of the treating oil in the tubular inlet means 2 and tubular outlet means 3 have a minimum area, in the embodiment of FIG. 3 the upper surfaces 2′ and 3′ of the treating oil within the tubular means 2 and 3 has an area which is approximately three times as great as the area of the oil surfaces 2′ and 3′ of FIG. 2. However, it is possible to accept the larger surface 2′ and 3′ of the treating liquid with the embodiment of FIG. 3 because with FIG. 3 it is not necessary to orient the components 9 vertically. In other words these components 9 in their partially finished condition issue in a substantially horizontal direction from the machine on which they are worked, and with the embodiment of FIG. 3 it is not necessary to swing the components 9 into a vertical position as is the case with FIG. 2. It is only required to provide for the components 9 a slight inclination in order to be able to introduce them one after the other into the inlet means 2 of FIG. 3 so that the embodiment of FIG. 3 can easily be incorporated into a production line so that the components 9 can continue to travel with little change in their orientation from the machine which works on the components 9 prior to the thermal treatment thereof with the embodiment of FIG. 3.

In order to transport the components 9 through the treating apparatus of the invention it is possible to utilize any available known transporting means in accordance with the requirements of the space which is available. Thus, among conventional units, which may be utilized for transporting the work pieces or components 9, are chutes or hollow shafts down which the components 9 may fall, while the movement of the components transversely through the hollow interior of the enclosure means 1 can be brought about by suitable conveyers such as those which have endless sprocket chains. In order to discharge the work pieces out of the hollow interior of the enclosure means 1 it is possible to use known buckets or flights carried by endless chains and projecting in a direction suitable for engaging beneath the work pieces and advancing them out through the outlet means. Also, as is shown in FIG. 5, it is possible to use inclined elevator or hoisting conveyers. In addition it is possible to do away with any mechanical interior structure within the enclosure means and outlet means in order to convey the components 9, and instead it is possible to use an electromagnetic assembly, situated at the exterior of the enclosure means and outlet means, having a traveling magnetic field which acts on the components to raise them out of the enclosure means 1.

According to the embodiment of the invention which is illustrated in FIG. 4, the enclosure means 10 is also closed off to a very great extent from the outer air. As is shown in FIG. 4, the hollow interior of the enclosure means 10 is provided with a horizontally extending conveyor means 11 in the form of a series of endless chains such as sprocket chains which are located beside each other and which have the upper and lower runs of the individual endless chains extending parallel to each other. These endless chains are guided around suitable sprockets as schematically illustrated in FIG. 4, and the shaft which carries the sprockets at one of the ends of the chains can extend fluid-tightly through a wall of the enclosure means 10 to be connected through a suitable transmission to a driving motor, for example. The inlet means of FIG. 4 is formed by a housing 19 which forms a tube having the opening 18 through which the components 9 are introduced, and the treating liquid within the enclosure means 10 extends into the hollow interior of the tubular means 19 which has the configuration of a cylindrical housing in the example of FIG. 4, so that the surface of the treating liquid extends across the interior of the housing 19 to partly seal off the interior of the enclosure means 10 from the outer atmosphere. However, in this case in order to further contribute to the sealing off of the enclosure means 10 of the outer atmosphere, the inlet means also includes an air-lock means 14 in the form of a rotary drum which slidably and fluid-tightly engages the inner surface of the housing 19. Thus, with the embodiment of FIG. 4, the inlet means 12 has the tubular structure 19 in the form of a housing which slidably and fluid-tightly accommodates a rotary air-lock drum 14 which is formed with pockets 16 for receiving the components 19 which extend horizontally in these pockets. The drum 14 is driven in any suitable way from the exterior of the housing 19, and the components 9 are delivered in sequence one after the other to the inlet 18 to fall from the latter into one of the pockets 16 as the air-lock drum 14 rotates.

The outlet means 13 has a construction similar to the inlet means 12 in that at the outlet means 13 there is also a tubular structure forming a cylindrical housing which fluid-tightly and slidably engages a rotary air-lock drum 15 driven in the same way as the drum 14, the outlet means 13 including the tubular structure 21 which receives the components 9 from the rotary air-lock drum 15 which is formed with the pockets 17 which receive the components 9 and deliver them to the tubular outlet portion 21 of the outlet means 13. Thus, in this case the inlet means 12 and outlet means 13 are situated at the top wall of the enclosure means 10 and include not only the tubular inlet and outlet structures but also the air-lock means situated respectively at the tubular inlet and outlet structures to further contribute to the sealing of the interior of the enclosure means 10 from the outer atmosphere. The inlet 18 is situated at the uppermost part of the air-lock housing 19. Also, this housing 19 is surrounded by a cooling jacket 20, and in the same way a cooling jacket 22 is provided around the housing of the air-lock means of the outlet means 13.

It will be noted that with the embodiment of FIG. 4, the outlet means 13 has its outer discharge tubular portion 21 inclined downwwardly toward the right. The treating liquid such as mineral oil within the enclosure means 10 extends up to elevation of the lower edge of the left end of the tubular outlet 21, this being the highest possible elevation for the treating liquid without spilling down through the outlet 21.

A transfer means is provided for transferring the components 9 from the conveyer means 11 to the outlet means 13, and in particular to the pockets 17 of the rotary drum 15 of the air-lock means at the outlet means 13. This transfer means takes the form of swingable arms 23 which extend into the spaces between the parallel chains and sprocket wheels at the right of FIG. 4 and which are acted upon by any suitable motion-transmitting structure so as to raise each component 9 at the proper time when it is to be received in a pocket 17 which has just turned in a clockwise direction, as viewed in FIG. 4, downwardly beyond the left end of the tubular outlet 21. For this purpose the shaft which carries the swingable arms 23 extends fluid-tightly through a wall of the enclosure means 10 to the exterior thereof where the shaft carries a lever which may be acted upon by any suitable rotary cam so as to bring about the required swinging movement of the transfer means 23. Thus, the drive for operating the conveyor means 11 and the drive for operating the rotary drums 14 and 15 as well as the drive for operating the transfer means 23 are all synchronized with each other so that all of these parts will operate in the proper timed relationship to bring about the continuous movement of the components 9 from the inlet means 12 along the interior of the enclosure means 10 and out through the outlet means 13.

As may be seen from the left of FIG. 4, a container 25 communicates through a tube 24 with the interior of the enclosure means 10. This container 25 has a hollow interior which extends at least up to the elevation of the lowermost part of the left end of the discharge tube 21, so that the treating oil can be situated not only in the enclosure means 10 but also in the interior of the tube 24 and the container 25. Thus, while maintaining the surface of the treating liquid in the container 25 at a select elevation it is possible to control the elevation of the treating liquid within the enclosure means 10, and more particularly to a desired extent above the top wall of the enclosure means 10 within the inlet means 12 and outlet means 13, and because the surface of the liquid is visible in the container 25 it is possible to see visually where the level of the treating liquid is at any time. Thus, by introducing liquid into the enclosure means 10 through supplying liquid to the interior of the container 25 it is possible to control the level of the treating liquid. The exterior surface of the container 25 may be provided with a cooling means such as a suitable water jacket. In general, however, there will be a given distance between the container 25 and the enclosure means 10 so that the free space which is provided in this way around the container 25 will serve as a result of the surrounding air temperature to maintain the oil in the compensating container 25 at the desired low temperature. Thus, the oil is maintained at a given level within the container 25 so as to equalize the level of the oil throughout the apparatus, and by spacing the container 25 from the enclosure means 10 it is possible to achieve the somewhat lower temperature for the oil in the container 25 simply by the differential between the oil and the ambient surrounding temperature. This maintenance of the temperature of the oil in the container 25 at somewhat below 200° C is particularly possible where the pipe 24 is of a relatively small diameter and, if desired, is provided with suitable cooling fins.

Thus, the interior of the enclosure means 10 and the equalizing container 25 are filled with the thermal treating oil the level of which is maintained almost up to the elevation of the lower edge of the left end of the discharge opening or tube 21. As was indicated above the rotary drums 14 and 15 have a fluid-tight sealed contact with the inner surfaces of the housings in which these drums rotate, so that the exposure of oil to the outer atmosphere at the inlet means 12 and outlet means 13 is of an extremely small order. In this way only a slight degree of oxidation of the treating oil can take place, and this undesirable oxidation is further diminished as a result of the cooling achieved by the cooling jackets 20 and 22. However, it is also possible to situate in the interiors of the inlet means 12 and outlet means 13 above the level of the treating liquid determined by the surface of the liquid in the container 25 an inert gas such as nitrogen which can be blown into the inlet means 12 and outlet means 13. However, it is not necessary to provide an inert gas at the upper surface of the liquid in the container 25 because the oil temperature in maintained in the container 25 at a temperature which is sufficiently low to prevent oxidation.

Thus, with the embodiment of FIG. 4 the components 9 are horizontally oriented, transversely to the plane of FIG. 4, when introduced through the opening 18 into the pockets 16 of the rotary drum 14 to be delivered to the conveyor 11. While conveyed by the conveyer 11 through the interior of the enclosure means 10, the components 9 are immersed within the oil which is maintained at a temperature of, for example, 250° C. At the right end region of the conveyor means 11 the transfer means 23 acts to raise the components 9 successively into the successive pockets 17 which turn so as to deliver the components to the discharge outlet 21 from which they issue to be further treated.

According to the embodiment of the invention which is illustrated in FIG. 5, the enclosure means 26 is of a substantially V-shaped configuration and requires far less space than is required by the embodiment of FIG. 4. It will be noted that the V-shaped configuration of the enclosure means 26 has the inlet means 27 and the outlet means 34 extending in an inclined direction along the arms of the V so that the inlet means 27 and outlet means 34 form at least in part extensions of the V-shaped configuration of the enclosure means 26 with this embodiment. The inlet means 27 also has an air-lock means formed by a rotary drum 30 provided with suitable pockets 31 for successively receiving the components 9 which are introduced in this case through an upper tubular portion 29 of inlet means 27. Below the air-lock means 30 the inlet means 27 includes the tubular portion 28 into which the treating liquid extends as shown in FIG. 5. However, it will be noted that the upper inlet portion 29 of the inlet means 27 is inclined more toward the horizontal then is the case with the portion 28 which forms an arm of the V-shaped configuration as pointed out above.

The outlet means 34 includes the elongated tubular portion 32 which forms part of the other arm of the V-shaped configuration, and it will be noted that the treating liquid also extends up into the tubular portion 32 of the outlet means 34. The hollow interior of the tubular portion 32 receives part of a conveyor means 33 which may have a construction which is the same as the conveyor means 11 except that the components of the conveyor means 33 are of a different size. The upwardly inclined conveyer means 33 extends downwardly from the tubular portion 32 of the outlet means 34 into the interior of the enclosure means 26 almost to the bottom end thereof, and it will be noted that the conveyor means 33 extends almost up to the top end of the tubular portion 32. The endless chains of the conveyor means 33 are provided with outwardly extending pins against which the components 9 can rest as they are raised upwardly, the chains with the conveyor means 11 being provided with similar outwardly directed pins as illustrated schematically in FIG. 4. The outlet means 34 also includes an air-lock means formed by a rotary drum 38 which is situated at the elevation of the top end of the conveyor means 33 and which is formed with the pockets 39 for successively receiving the components 9 at the opening 35 where the air-lock means communicates with the tubular portion 32. The rotary drum 38 of course has a fluid-tight sliding engagement with a housing portion which receives the rotary drum 38 and which forms part of the outlet means 34.

A guide means is provided for guiding the work pieces or components 9 to and from the conveyer means 33. This guide means includes a series of bars 37 fixed to the lower left wall portion of the enclosure means 26 and extending therefrom in a downwardly inclined direction shown in FIG. 5 into the spaces between the several chains of the conveyer means 33, so that components 9 which fall from the drum 30 downwardly along the interior of the tubular portion 28 of the inlet means 27 will be guided by the bars 37 directly onto the conveyer means 33 to be raised thereby through the treating bath. This guide means also includes the bars 36 which are fixed to the tubular portion 32 of the outlet means just below the opening 35, in line with the lower edge of the opening 35, these bars 36 also extending into the spaces between the chains and thus receiving the work pieces 9 to guide the latter from the conveyer means 33 into the successive pockets 39 of the rotating drum 38. This drum 38 delivers the work pieces 9 successively to the outlet tubular portion 40 of the outlet means 34, from which the work pieces 9 are received by a suitable conveyer or the like which transfers the work pieces to further treating structure. Thus, it will be noted that his outlet portion 40 of the outlet means 34 is inclined downwardly toward the right, as viewed in FIG. 5.

While in the case of FIG. 4 it was required that the treating oil extend up to the elevation of the lower portions of the drums 14 and 15, in the embodiment of FIG. 5 it is not necessary for the oil to extend all the way up to the rotary drums 30 and 38. Thus, with the embodiment of FIG. 5 the treating oil can have free upper surfaces in the tubular portions 28 and 32 situated at elevations lower than the drums 38 and 30, respectively. Within the spaces between the rotary drums 30 and 38 and the upper surfaces of the treating liquid it is possible to easily locate an inert gas which may be continuously supplied to these spaces so that the inert gas is maintained continuously in engagement with the upper free surfaces of the treating liquid and reaches into the slight gaps which may be present at the locations where the rotary drums 30 and 38 slidably engage the inner surfaces of the housing portions in which they rotate. The leakage of the inert gas out through these gaps is relatively small so that it is a simple matter to provide a continuous supply of inert gas in this manner. In the embodiment of FIG. 5 the treating oil within the enclosure means 26 is also maintained at a temperature of approximately 250° C.

The operation of the embodiment of FIG. 5 starts with the introduction of the work pieces 9 successively into the inlet tube 29 to be received by the pockets 31 of the rotary drum 30 with the work pieces 9 being horizontally oriented as illustrated in FIG. 5. These components 9 are successively fed to the pockets 31 and fall from the latter downwardly along the interior of the tubular portion 28 to be received in the enclosure means 26 where they are guided by the bars 37 to the conveyer means 33. The conveyor means raises the components 9 until they reach guide bars 36 which direct them to the pockets 39 of the rotary drum 38 from where they are delivered to the outlet tubular portion 40.

A basically different type of apparatus according to the invention is illustrated in FIG. 6. In this embodiment, the hollow interior of the enclosure means 41 is provided with a receptacle 42 which contains the treating oil. The inlet means of FIG. 6 includes a receptacle 43 while the outlet means includes a receptacle 44, and these receptacles 43 and 44 are also provided with liquid. The left and right end walls of the enclosure means 31 are formed with openings in which the receptacles 43 and 44 are accommodated, and these end walls are slotted to receive vertical walls of the receptacles 43 and 44, so that the end walls of the enclosure means 41 can project down into the liquid within the receptacles 43 and 44 to provide in this way liquid seals shutting off the interior of the enclosure means 41 from the outer atmosphere. The liquid for the liquid seals provided at the receptacles 43 and 44 is distinct from the liquid provided in the receptacle 42. In order to transport the work pieces or components 9, a conveyer means 45 is provided. However in this case the conveyer means 45 does not take the form of endless chains. Instead the conveyer means 45 is in the form of a suitable belt. This belt has a width somewhat longer than the length of the work pieces 9. The belt is made of any suitable material which will not be influenced by the treating oil and the liquid in the receptacles 43 and 44. The belt has fixed to its outer surface the pins which are illustrated so as to accommodate the work pieces 9 between these pins in the manner illustrated. While the belt is guided around suitable relatively large rollers at the exterior of the receptacles 42–44, as illustrated, within the receptacles the belt is guided around discs. Thus, considering the upper left portion of FIG. 6, it will be seen that as the belt travels around the upper left roller at the upper left region of the receptacle 43, the belt is inclined downwardly toward the right and then passes around a first pair of parallel discs. These discs are spaced from each other and fixed to the free ends of a pair of shafts carried by the vertical walls of the receptacle 43 which extend into the slots of the left wall of the enclosure means 41. In this way there is provided between these discs a free space through which the pins which project from the belt can freely travel. In the same way the belt is guided by additional pairs of parallel rotary discs in the several receptacles. Thus, these pairs of parallel discs together with the larger guide rollers at the exteriors of the receptacles serve to guide the conveyor means 45 first downwardly into, then along the interior of, then outwardly out of each of the successive receptacles 43, 42 and 44, in the manner illustrated in FIG. 6. At the upper left guide roller shown in FIG. 6 there are a plurality of guide bars which extend between the pins projecting from the belt to guide the work pieces 9 successively to the space between these pins so that in this way the work pieces are introduced into the receptacle 43. In the same way, guide bars which are inclined downwardly toward the right shown at the upper right portion of FIG. 6, extend between the pins to receive the work pieces after they move out of the receptacle 44. The lower run of the endless conveyer means 45 extends horizontally beneath the lower surface of the enclosure means 41 in the manner illustrated in FIG. 6. Any one of the larger drums or rollers at the exterior of the enclosure means of FIG. 6 can be driven from a suitable motor through a suitable transmission so as to maintain the conveyer means 45 in movement in order to transport the work pieces in the manner illustrated in FIG. 6.

With the embodiment of FIG. 6 there is of course a substantial free space in the interior of the enclosure means 41 which is not occupied by treating liquid. It is a simple matter to maintain this interior free space of the enclosure means 41 filled with an inert gas which is at a relatively low pressure above atmospheric pressure. The receptacles 43 and 44 may contain the same oil as the receptacle 42. However, the oil in the receptacles 43 and 44 is advantageously maintained at a lower temperature on the order of, for example, 150°–190° C, while the oil in the bath or receptacle 42 is maintained at a temperature on the order of 250° C, so that in this way oxidation of the oil at the receptacles 43 and 44 is avoided.

Thus, with the apparatus of the invention the components 9 are thermally treated in mineral oil maintained at a temperature of 200°–300° C. With the method and apparatus of the invention, in order to accelerate the transfer of heat, the metal components 9 are practically instantaneously contacted over their entire surface area by the treating oil. Moreover it is advantageous to feed the metal components 9 quickly one after the other through the bath which is maintained at the proper treating temperature, so that in this way a dwell time of the metal components in the treating bath on the order of 1–2 minutes is sufficient.

The operating time of the thermal oil is increased by maintaining the exposed surface thereof at a minimum at the inlet and outlet means as well as by utilizing the air-locks structures as described above. Moreover, at the inlet and outlet means the temperature of the oil is maintained at a temperature which is under 200° C, at a temperature of approximately 190° C, for example. Furthermore, by contacting the exposed surface of the treating oil with a layer of reducing or inert gas such as nitrogen, it is possible to further lengthen the operating life of the treating oil.

The continuous movement of the work pieces 9 without changing their orientation while they extend horizontally and while they are moved transversely with respect to their longitudinal axes provides an exceedingly great saving of space. It is to be noted that with the method and apparatus of the invention as illustrated in the above embodiments, the delivery of the components or work pieces 9 to the treating apparatus is carried out in such a way that formation of air bubbles in the treating liquid and spraying of the treating liquid is maintained at a minimum so that unnecessary oxidation of the oil is avoided. It is particularly for this latter reason that it is desirable to cover the exposed oil surfaces with an inert gas such as nitrogen.

What is claimed is:

1. In an apparatus for thermally treating metal components, enclosure means having a hollow interior space for containing in said space a liquid at an elevated temperature in which the metal components are thermally treated, inlet means connected to and communicating with the interior of said enclosure means for introducing components to be treated into the interior space of said enclosure means, outlet means spaced from said inlet means and connected to and communicating with the interior of said enclosure means for discharging components out of the interior space of said enclosure means, said inlet and outlet means forming the only passages through which the components can travel into and out of the interior of said enclosure means and both having interior hollow spaces for receiving liquid extending completely across the latter spaces for preventing communication between the interior spaces of said enclosure means and the outer atmosphere, said inlet and outlet means both extending to an elevation higher than the hollow interior space in said enclosure means where the treating liquid is located, said enclosure means having a wall which at least substantially closes off the entire interior of said enclosure means except for said inlet and outlet means, and conveyer means situated in said enclosure means for conveying components to be treated along a predetermined horizontal path in a treating liquid contained in said hollow interior space of said enclosure means with said predetermined path being situated above the bottom of the treating liquid and having a predetermined length, and said enclosure means providing for the treating liquid a a depth which is less than the length of said path.

2. The combination of claim 1 and wherein said inlet and outlet means both have at said spaces thereof cross-sectional configurations conforming to the cross-sectional configuration of the metal components for introducing and discharging the metal components into and out of the interior space of said enclosure means with a relatively small clearance around the components as they travel through the inlet and outlet means.

3. The combination of claim 1 and wherein said inlet and outlet means are each provided with an air-lock means for further contributing to the sealing of the interior space of said enclosure means from the outer atmosphere.

4. The combination of claim 1 and wherein said inlet and outlet means are each in the form of an elongated tubular structure into which the liquid in the enclosure means extends.

5. The combination of claim 4 and wherein said tubular structures each has a configuration providing a minimum contact between the liquid and air during movement of components into and out of the enclosure means.

6. The combination of claim 5 and wherein said tubular structures extend vertically.

7. The combination of claim 1 and wherein each of said inlet and outlet means carries an air-lock means for further contributing to the sealing of the interior space of said enclosure means from the outer atmosphere, each of said air lock-means including a rotary drum formed with pockets for receiving the metal components and a housing in which the rotary drum is capable of turning with the drum and housing having a gas-tight engagement at surfaces of said drum which slidably engage surfaces of said housing, the gas-tight engagement between each drum and housing extending completely around each drum.

8. The combination of claim 7 and wherein the outlet means includes a discharge tubular structure for receiving the metal components from the air-lock means at said outlet means, and the liquid being filled within the enclosure means and the inlet and outlet means up to the elevation of the discharge tubular structure which receives the metal components from the air-lock means at said outlet means.

9. The combination of claim 7 and wherein said conveyor means is accommodated in the interior of said enclosure means for conveying metal components therethrough, and transfer means cooperating with said conveyer means to the rotary drum of the air-lock means at said outlet means.

10. The combination of claim 9 and wherein said conveyer means includes a plurality of conveyer chains operating synchronously and situated in side-by-side relation.

11. The combination of claim 10 and wherein said transfer means includes swingable arms situated between the conveyer chains for raising the components from the latter to the rotary drum of the air-lock means at said outlet means.

12. The combination of claim 1 and wherein a circulating means communicates with the interior of said enclosure means for circulating treating liquid therethrough, and heating means operatively connected with said circulating means for heating the treating liquid.

13. The combination of claim 1 and wherein a container communicates with the interior of said enclosure means and has an interior situated at an elevation at least as high as the top of said enclosure means so that through said container a treating liquid can be supplied to the interior of said enclosure means and maintained at a given elevation therein.

14. The combination of claim 13 and wherein said container is spaced from said enclosure means and wherein a tube provides communication between said container and enclosure means.

15. The combination of claim 14 and wherein said container and tube have an exterior surface situated beyond said enclosure means, and cooling means situated at at least part of said exterior surface for cooling the latter.

16. The combination of claim 1 and wherein in the interior of said enclosure means over the surface of a treating liquid therein there is a reducing or inert gas such as, for example, nitrogen which is maintained in said enclosure means over the liquid therein at a relatively small pressure above atmospheric pressure.

17. The combination of claim 1 and wherein a cooling means surrounds each of said inlet and outlet means.

18. In an apparatus for thermally treating metal components, enclosure means having a hollow interior space for containing in said space a liquid in which the metal components are thermally treated, inlet means connected to and communicating with the interior of said enclosure means for introducing components to be treated into the interior space of said enclosure means, and outlet means spaced from said inlet means and connected to and communicating with the interior of said enclosure means for discharging components out of the interior space of said enclosure means, said inlet and outlet means forming the only passages into and out of the interior of said enclosure means and both having interior hollow spaces for receiving liquid extending completely across the latter spaces for preventing communication between the interior space of said enclosure means and at the outer atmosphere, said inlet and outlet means each including a receptacle for receiving a liquid and having an open top, and said enclosure means having wall portions which extend downwardly into the interior of said receptacles beneath the surface of a liquid therein for providing liquid seals at said inlet and outlet means, the components travelling through the receptacles into and out of the interior of said enclosure means, said enclosure means including in its interior a third receptacle situated between the receptacles of said inlet and outlet means and containing its own treatment path, and conveyer means in the form of an endless chain structure having an upper run extending sequentially through the receptacle of said inlet means, the receptacle in the interior of said enclosure means, and the receptacle of said outlet means for successively conveying work pieces therethrough.

* * * * *